United States Patent [19]

Froutzis

[11] 4,216,564

[45] Aug. 12, 1980

[54] DRAPERY HANGER

[76] Inventor: Andrew Froutzis, 54532 Glenwood Park Dr., Elkhart, Ind. 46514

[21] Appl. No.: 18,777

[22] Filed: Mar. 8, 1979

[51] Int. Cl.[2] ..... A47H 13/12

[52] U.S. Cl. ..... 16/93 D; 16/95 D

[58] Field of Search ..... 16/87.2, 87.4, 93 R, 16/93 D, 95 D; 160/126, 330, 341, 345

[56] References Cited

U.S. PATENT DOCUMENTS

| | | | |
|---|---|---|---|
| 2,412,608 | 12/1946 | Fridolph | 160/126 |
| 2,562,029 | 7/1951 | Fridolph | 160/330 X |
| 2,648,379 | 8/1953 | Bishop | 160/341 |
| 3,286,299 | 11/1966 | Golden | 16/87.4 R |
| 3,378,879 | 4/1968 | Stall | 16/93 D X |
| 3,823,439 | 7/1974 | Selset | 16/87.2 X |

FOREIGN PATENT DOCUMENTS

| | | | |
|---|---|---|---|
| 642639 | 9/1950 | United Kingdom | 16/87.4 R |

*Primary Examiner*—Werner H. Schroeder

*Attorney, Agent, or Firm*—Oltsch, Knoblock & Hall

[57] ABSTRACT

A drapery hanger having a support with a channel shaped track and a flexible tape secured to the upper margin of a drape and characterized by integral longitudinally spaced track-engaging parts each terminating in a V-shaped flange adapted for snap interlock with said track and slidable engagement in said track while supporting the weight of the drape.

7 Claims, 8 Drawing Figures

Fig. 3
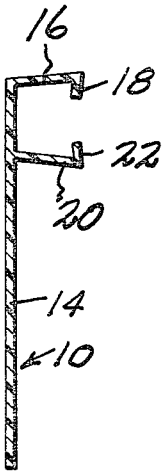
Fig. 4
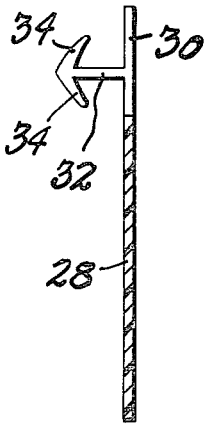
Fig. 5
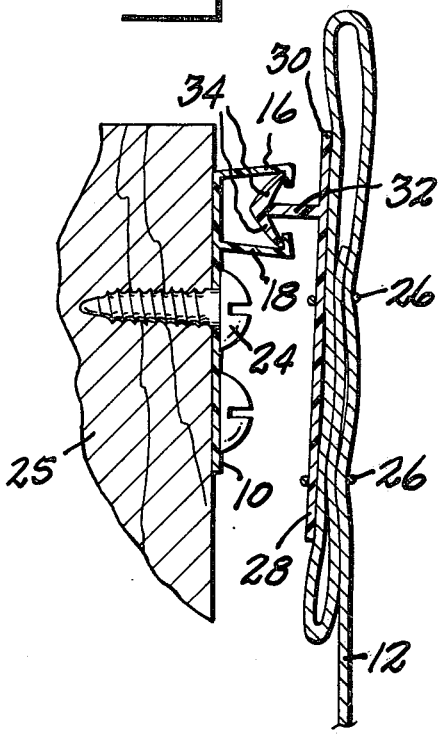
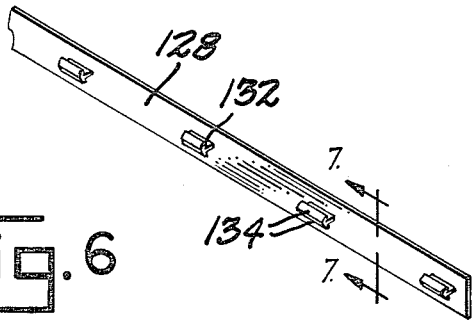
Fig. 6
Fig. 8
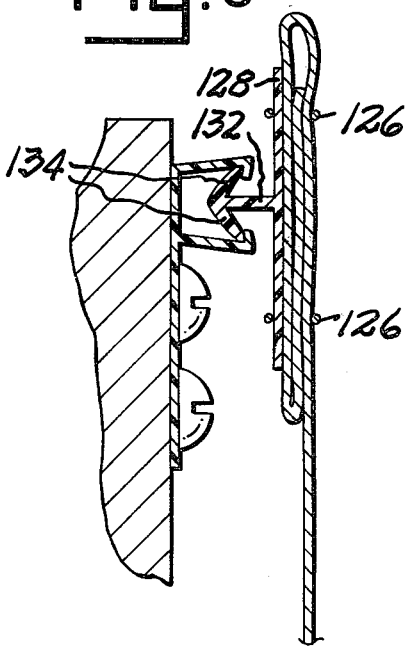
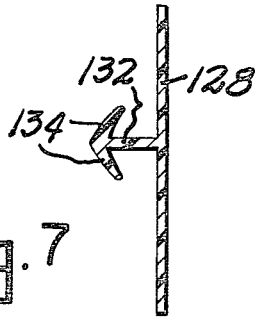
Fig. 7

DRAPERY HANGER

SUMMARY OF THE INVENTION

This invention relates to improvements in drapery hangers.

Heretofore it has been common to provide drapery hangers by which drapes are suspended which include slide members shiftable in a selected path along the length of a fixed channel and wherein each slide member is provided with a socket for snap interlock with and support of a headed member carried by the upper margin of the drape and detachable from the socket of the slide member in which it is received, such a construction is disclosed in my prior application, Ser. No. 889,365, filed Mar. 23, 1978.

In another prior application, Ser. No. 956,316, filed Nov. 3, 1978, I disclosed a novel hanger having a fixed horizontal channel portion to receive with a snap interlock a plurality of headed members projecting from and secured to a tape sewn to a drape and directly engageable with and interlocked with the supporting channel.

Prior constructions of these and other types have accommodated separation of a drape from a hanger or carrier for cleaning purposes but use constructions entailing substantial cost of parts and labor required for assembly. Also, many prior constructions have required inconvenient methods of dismounting drapes for cleaning and remounting them, and/or provision of parts secured to drapes which interfere with or make difficult the cleaning of drapes when removed from the hanger.

It is the primary object of this invention to provide a drapery hanger by which assembly and disassembly is rapid and simple, and which is of low cost.

A further object is to provide a drapery hanger which eliminates the need for use of metal snap fasteners and/or fabric reinforcing tapes.

A further object is to provide a drapery hanger in which firm anchorage of a drape to a support is provided and in which a track or support member and drape mounted slides are of novel configuration to accommodate rapid assembly and disassembly of drapes relative to the track or support.

Other objects will be apparent from the following specification.

BRIEF DESCRIPTION OF THE DRAWINGS

FIG. 3 is an enlarged vertical transverse sectional view taken on line 3—3 of FIG. 2.

FIG. 4 is an enlarged vertical transverse sectional view taken on line 4—4 of FIG. 2.

FIG. 5 is an enlarged fragmentary sectional view illustrating the interengagement of drape-carried hanger parts with a track or support and taken on line 5—5 of FIG. 1.

FIG. 6 is a fragmentary perspective view of a modified construction of the drape-mounted part of the construction.

FIG. 7 is a transverse sectional view taken on line 7—7 of FIG. 6.

FIG. 8 is a fragmentary vertical sectional view of the modified embodiment of the invention and similar to the sectional view shown in FIG. 5.

DESCRIPTION OF THE PREFERRED EMBODIMENT

Figure 1:
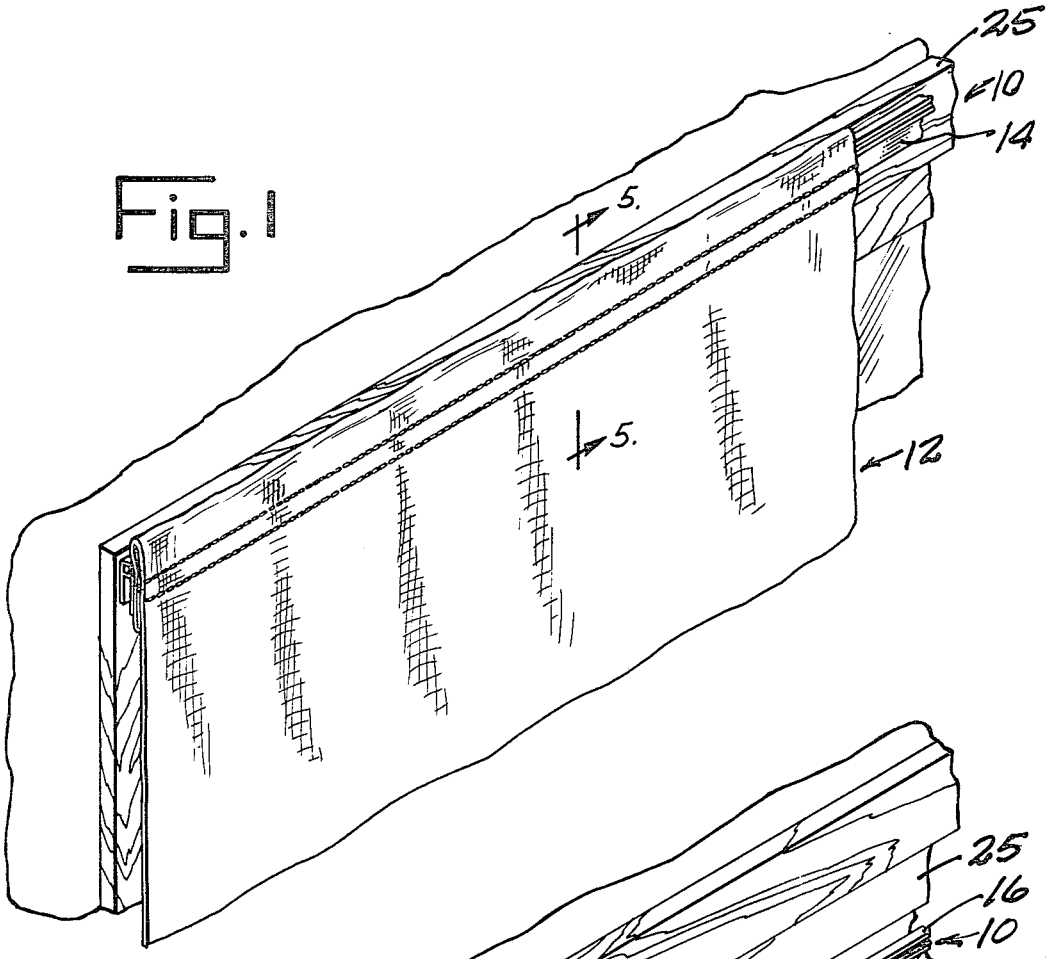
FIG. 1 is a fragmentary perspective view illustrating one embodiment of my new drapery hanger in operative condition.
Figure 2:
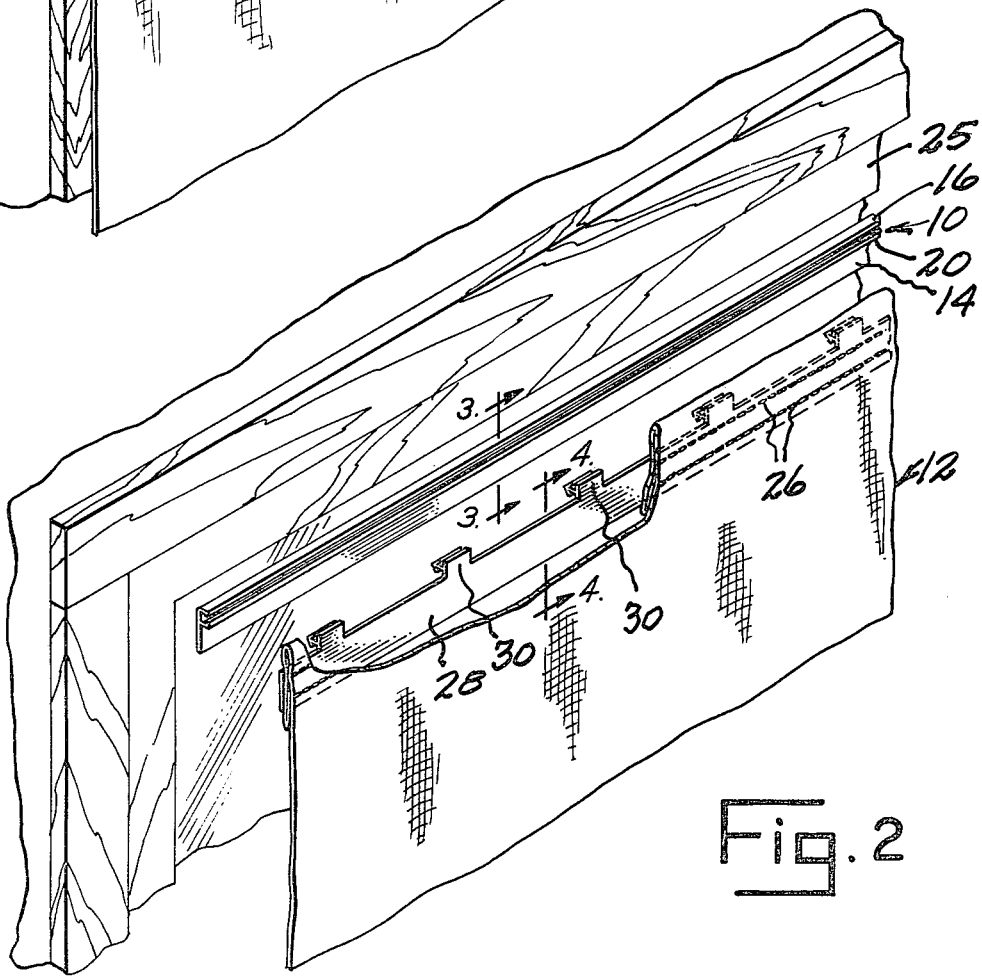
FIG. 2 is a fragmentary exploded perspective view of the drapery hanger and drape illustrated in FIG. 1.

Referring to the drawings, and particularly to FIGS. 1–5 which illustrate one embodiment of the invention, the numeral 10 designates a drapery hanger or track adapted to be mounted above an opening in a building, a mobile home or a travel trailer, as upon the frame of a window or door which is to be spanned by a drape 12. The hanger or track 10 preferably constitutes an extrusion of any suitable material, such as metal or plastic which is substantially shape retaining or rigid or which has limited resilience. One preferred plastic material is polyvinylchloride (PVC). The hanger is characterized by a flat plate portion 14 and an integral, longitudinal, marginal channel having an upper leg or flange 16 with a downturned end lip 18 and a lower channel leg or flange 20 having an upturned marginal end lip 22. The flanges 16 and 20 preferably extend in slightly divergent directions from the plate 14 and are of the same length and width. Lips 18 and 22 preferably extend slightly inwardly or rearwardly toward the plate 14 at their free edges and are spaced apart and disposed in vertical relation. The width of the plate portion 14 is sufficient to provide for reception of suitable securing means 24, such as screws by which the drapery hanger may be firmly secured to a supporting wall or window frame 25.

The drape 12 has stitched thereto at 26 at its upper marginal portion a strip 28 or tape of a flexible plastic material, such as nylon or polypropylene. At spaced intervals tabs 30 project laterally from the tape 28 at the upper margin thereof and preferably are formed integrally with the tape. Each tab 30 has projecting therefrom intermediate its height a lateral preferably integral flange 32 from the free end of which project longitudinal laterally extending anchor flanges 34. The anchor flanges 34 preferably extend divergently toward the mounting tab 30 in V-shape or in a configuration comparable to an arrowhead. The spacing of the upper and lower marginal tips of the anchor flanges 34 is greater than the spacing between the inner confronting edges of the channel lips 18 and 22 and less than the spacing between the inner faces of the channel legs or flanges 16 and 20.

The tape or strip 28 is of a width to accommodate spaced longitudinal lines of stitching 26 to insure firm anchorage of the strip to the upper portion of the drape, preferably below the upper margin of the drape as shown in FIG. 5. The arrowhead or V-shaped anchor flanges 34 are sufficiently resilient to flex to accommodate snap application thereof to the channel or track 26-20 through the channel mouth under pressure applied perpendicularly to the channel and to accommodate restoration of said flanges 34 to normal shape to seat behind the channel lips 18 and 22 when so installed. The V-shaped or arrowhead anchor flanges are of a size to accommodate free sliding thereof within the hanger track or channel, and the tape is of sufficient flexibility to accommodate bending or flexing thereof between the longitudinally spaced anchor flanges 32–34 incident to pleating or folding of the drapes. The flexibility of the V-shaped or arrowhead anchor flanges 34 is preferably sufficient to accommodate snap release thereof from the channel or track 16–20 by a pull transversely of the channel in the event the channel ends are closed.

It will be noted that each of the hanger 10 and the tape or strap 28 with its flanges 32–34 are formed integrally. Thus no assembly of component parts, aside from anchorage of the hanger 10 to the building and stitching of the tape 28 to the drape is required. Also, the assembled structure of hanger and tape is sufficiently strong to support the weight of the drape 12 and to avoid unintentional separation of the drape from the hanger, without requiring unnatural or distasteful shaping or appearance of the supported drape.

An alternative construction is illustrated in FIGS. 6, 7 and 8, wherein parts similar to those previously described bear the same reference numerals. In this construction, the hanger or track 10 is constructed similarly to the hanger previously described. Only a slight difference of the shape of the drape-carried tape is involved. In this construction a tape 128 has projecting therefrom, at longitudinally spaced intervals, longitudinally extending flanges 132 substantially perpendicular to the tape 128 and substantially mid width thereof. At the free longitudinal margin of each flange 132 extend longitudinal flanges 134 of V-shaped or arrowhead configuration, as of the shape, properties and proportions of the arrowhead anchor flanges 34 previously described. In this arrangement the longitudinal margins of the tape 128 are stitched at 126 at opposite sides of the flange 132 and anchor flanges 134, as best seen in FIG. 8. This construction has the same characteristics as the first embodiment, preferably including the integral formation of the flanges 132 and 134 with the tape 128, and the properties of resilience and flexibility of the tape 128 required to accommodate pleating or folding of the drapes, and to accommodate snap application of the V-shaped or arrowhead anchor flanges 134 in the channel 16–20 and free sliding of the V-shaped or arrowhead flanges in the channel with firm anchorage or support of the drapes by the track.

While the preferred embodiments of the invention have been illustrated and described, it will be understood that changes in the construction may be made within the scope of the appended claims without departing from the spirit of the invention.

What I claim is:

1. In the combination of a drapery hanger adapted to be secured to a support and a drape detachably and slidably suspended from the hanger, wherein the hanger has an elongated side-opening channel portion characterized by upper and lower spaced flanges with spaced inturned longitudinal lips at the mouth of the channel, the improvement wherein a flexible tape secured to the face of the upper margin of the drape has formed integrally therewith a plurality of longitudinally spaced laterally projecting longitudinal flanges from the outer longitudinal margin of each of which project integral divergent flanges whose total width is greater than the spacing between the lips of the hanger flange, said divergent tape flanges being slidable in said channel and providing for suspension of the drape from the hanger, said divergent flanges being sufficiently resilient to accommodate flexing thereof for snap action application thereof to and removal thereof from the hanger channel.

2. In the combination defined in claim 1, said divergent flanges extending angularly from said first flanges and toward said tape.

3. In the combination defined in claim 1, said divergent flanges having a V-shaped outer surface in cross section.

4. In the combination defined in claim 1, said divergent flanges having a substantially V-shape in cross section.

5. In the combination defined in claim 1, said tape and flanges being formed integrally of a plastic material of the category including nylon and polyethylene.

6. In the combination defined in claim 1, said tape including spaced integral laterally projecting tabs at one longitudinal margin thereof, each of said flanges being carried by and projecting laterally from a tab.

7. In the combination defined in claim 1, said flanges projecting laterally from said tape and spaced from and between the marginal edges of the tape.

* * * * *